United States Patent [19]

Schneeberger et al.

[11] 4,084,546

[45] Apr. 18, 1978

[54] HEAT EXCHANGER

[75] Inventors: Martin Schneeberger, Wolfratshausen; Dieter Wittmann, Geretsried, both of Germany

[73] Assignee: Linde AG, Wiesbaden, Germany

[21] Appl. No.: 720,427

[22] Filed: Sep. 3, 1976

[30] Foreign Application Priority Data

Sep. 4, 1975 Germany ..... 2539440

[51] Int. Cl.[2] ..... F22B 1/16; F28D 7/10; F28F 9/22

[52] U.S. Cl. ..... 122/32; 165/140; 165/145; 165/163

[58] Field of Search ..... 122/32, 33, 34; 165/140, 141, 144, 145, 154, 155, 156, 163

[56] References Cited

U.S. PATENT DOCUMENTS

| | | | |
|---|---|---|---|
| 2,819,882 | 1/1958 | Stephani | 165/140 |
| 3,316,961 | 5/1967 | Dorner | 165/145 |
| 3,742,915 | 7/1973 | Meshii | 165/145 |

FOREIGN PATENT DOCUMENTS

| | | | |
|---|---|---|---|
| 1,205,952 | 8/1959 | France | 165/140 |

*Primary Examiner*—Kenneth W. Sprague
*Attorney, Agent, or Firm*—Karl F. Ross

[57] ABSTRACT

A heat exchanger has at least two cylindrical shells defining annular chambers lying one within the other. One of the annular chambers receives a tube bundle consisting of straight tubes while the other annular chamber receives a tube bundle of coiled tubes. The heat exchanger is particularly suitable for the heating of feed water (traversing the tubes) with steam (traversing the annular chambers) in a power plant in which the heat exchanger is disposed directly beneath the turbine on the turbine mount.

7 Claims, 4 Drawing Figures

HEAT EXCHANGER

FIELD OF THE INVENTION

The present invention relates to a heat exchanger and, more particularly, to a high-efficiency heat exchanger for the heat transfer between steam and feed water having a turbine-operated electrical power plant.

BACKGROUND OF THE INVENTION

It is known to provide heat exchangers which have at least two cylindrical shells lying one within the other and defining a pair of annular chambers disposed one within the other, for power plants having steam-driven turbines for the generation of electrical energy.

Such heat exchangers have been used in the past for the heating of feed water of the power plant. In order that the flow paths for the steam and feed water may be kept as short as possible, because the heat exchanger is generally disposed directly beneath the turbine on the turbine mount of the power plant and its dimensions are limited between fittings necessary to communicate with other parts of the power plant, the heat exchanger is provided with annular chambers, as described, to be traversed by the steam and with tube bundles or the like which can be traversed by the feed water.

The feed water flows through the heat exchanger at high pressure and with high speed and hence pressure drops must be minimized within the heat exchanger. Furthermore, the outer dimensions of the heat exchanger, the locations of the inlet and outlet fittings on the heat exchanger structure and the internal volume of the heat exchanger are generally fixed by the requirements for positioning of the heat exchanger in relation to the turbine as described. Usually the feed water must be led from the same side of the heat exchanger as it is introduced.

It has already been pointed out that feed water preheaters for power plants of the aforementioned type have been provided heretofore with inner and outer annular chambers each receiving a tube bundle of U-shaped bent tubes. The feed water is fed to the heat exchanger at one of its end faces, is passed through the U-shaped bent tubes in the next annular chamber in a foward and return direction, is then conducted into the outer annular chamber and trasverses the U-shaped tubes therein in the forward and reverse directions before being discharged from the heat exchanger.

The steam at elevated pressure is supplied at the other end face of the heat exchanger in order to insure a uniform heat transfer to the U-shaped tubes in the inner chamber. In addition, complicated inserts and devices must be used in the annular chambers to insure effective steam distribution.

Since, however, the distance between the inlets and outlet for the heat exchanging fluids is fixed (by reason of the location at which the heat exchanger must be installed with relation to the turbine set), the heat exchanger has a limited length. Moreover, the flow velocity of the feed water is generally so high that errosion damage can occur, leading to breakdown of the system. The high inlet velocity of the feed water is also accompanied by a high and disadvantageous pressure drop.

OBJECT OF THE INVENTION

It is the object of the present invention to provide an improved heat exchanger, especially for the aforedescribed purpose, with simplified distribution and flow of the heat exchange fluid, with increased operating life and high effectiveness even where limited in length, and with effective heat exchange for a given orientation or positioning of the inlet and outlet fittings for the heat exchange fluids.

SUMMARY OF THE INVENTION

Basically, this object and others which will become apparent hereinafter are attained, in accordance with the present invention, in a heat exchanger, especially for the heating of the feed water for a power plant, adapted to be mounted upon the turbine structure thereof, which comprises a pair of annular chambers defined by substantially coaxial walls as previously described but having in at least one of the annular chambers a tube bundle formed of straight tubes while another annular chamber receives a tube bundle of coiled tubes.

According to the invention, the heat exchange fluid traversing the tubes, generally the feed water, passes from the first end face of the heat exchanger through one of the heat exchangers through one of the annular chambers in the tube bundle thereof and, after the single pass through this annular chamber, is conducted to the next annular chamber. After traversing the latter chamber in a single pass, the heat exchange fluid is discharged in the same end face of the heat exchanger as that at which it was introduced.

Since the fluid traversing the tubes passes through each annular chamber only onece, the total effective flow cross section for the tube of the bundles in each annular chamber should be approximately twice as great as the total effective flow cross section and systems in which the fluid passes back and forth through each chamber. Thus the flow velocity of the fluid in the tubes can be sharply reduced, for example by about a half.

A fluid of lower flow velocity gives rise to a reduced pressure drop and is less apt to cause errosion damage. As a result the heat exchanger has a sharply increased useful life. The increased heat exchange surface required for the increased flow cross section can be obtained by providing in at least one annular chamber, as mentioned above, a tube bundle consisting of coiled tubes, i.e. a multiplicity of helical tube coils which can be wound upon a mandrel and upon other coils of this coil-tube bundle.

In addition, the annular chamber receiving the coiled-tube bundle can be that chamber at which the greatest heat transfer occurs, i.e. the chamber in which the heat exchange fluids have the greatest temperature differential.

The other fluid involved in the heat exchange process can be fed radially into and conducted radially from the outer shell of the heat exchanger at appropriate locations. The orientation and positioning of the tube bundles is independent of the supply fittings for the fluids traversing the free space in the annular chambers, It is not necessary to provide fittings at the opposite end face of the heat exchanger so that an increase in the effective length of the latter for a given available space can be achieved.

Furthermore, the radial inlet fittings can be positioned and oriented to insure an optimal distribution of the second heat exchange fluid and an effective contact thereof with the tube bundles. Inserts, such as baffles and the like, for distributing the second fluid within the annular chambers can be greatly simplified and/or reduced to a minimum.

When the heat exchanger is used to preheat the feed water for an electrical power plant, it preferably comprises two annular chambers disposed one within the other, the inner annular chamber receiving the coiled-tube bundle.

The feed water is thus supplied from the first end face of the heat exchanger and initially traverses the stright-tube bundle in the outer annular compartment, is conducted to the next annular compartment through the coiled-tube bundle and emerges at the inlet side of the heat exchanger.

A second fluid, for example high-pressure steam, is fed into the heat exchanger radially from the top of the shell of the heat exchanger in the region of the second end face thereof and is passed through the outer annular chamber into the inner annular chamber, being removed from the inner annular chamber at the bottom of the shell of the heat exchanger. A third fluid, for example low-pressure steam, is fed into the outer annular chamber through a plurality, for example four inlets, at the upper part of the shell of the heat exchanger and is removed at the bottom of the latter. It is possible, however, to connect the discharge side of one annular compartment to the inlet side of another annular compartment within the framework of the present invention.

An important advantage of the present invention resides in the fact that the flow cross sections of the straight-tube bundle and the coiled-tube bundle can be provided one after the other (in series) with the flows of the fluid through the tube bundles being in opposite directions. The heat exchanger thus has its tube sections connected one after the other in series and shell sections (annular compartments) in parallel. The fluid traversing the tubes, generally the fluids to be heated, can thus flow through the heat exchanger from the cold to the warm end. Furthermore, minimum outer dimensions obtain.

The heat exchanger according to the invention is especially advantageous for use as part of a thermal power plant for the preheating of the feed water, especially when the flow cross sections of the annular compartments are sealed from one another, each annular compartment being provided with respective inlet and outlet fittings or disks. In the region of the inlet to the inner annular compartment at the inner shell, an inlet chamber is provided which extends over substantially the entire length of the inner compartment. Because of the restricted size of a feed water preheater, this arrangement affords considerable advantage since it enables an optimum heat exchange to be achieved.

The uniform distribution of the fluids admitted through the inlet fittings can be improved still further when baffle plates are provided in the region of the inlet. The feed water preheater according to the invention has the possibility of admitting and discharging the feed water from one end face of the heat exchanger, especially if an end face of the heat exchanger is provided with a closure or can define a collecting chamber and a discharge chamber sealed from one another.

BRIEF DESCRIPTION

The above and other objects, features and advantages of the present invention will become more readily apparent from the following description, reference being made to the accompanying drawing in which.

SPECIFIC DESCRIPTION

Figure 1:
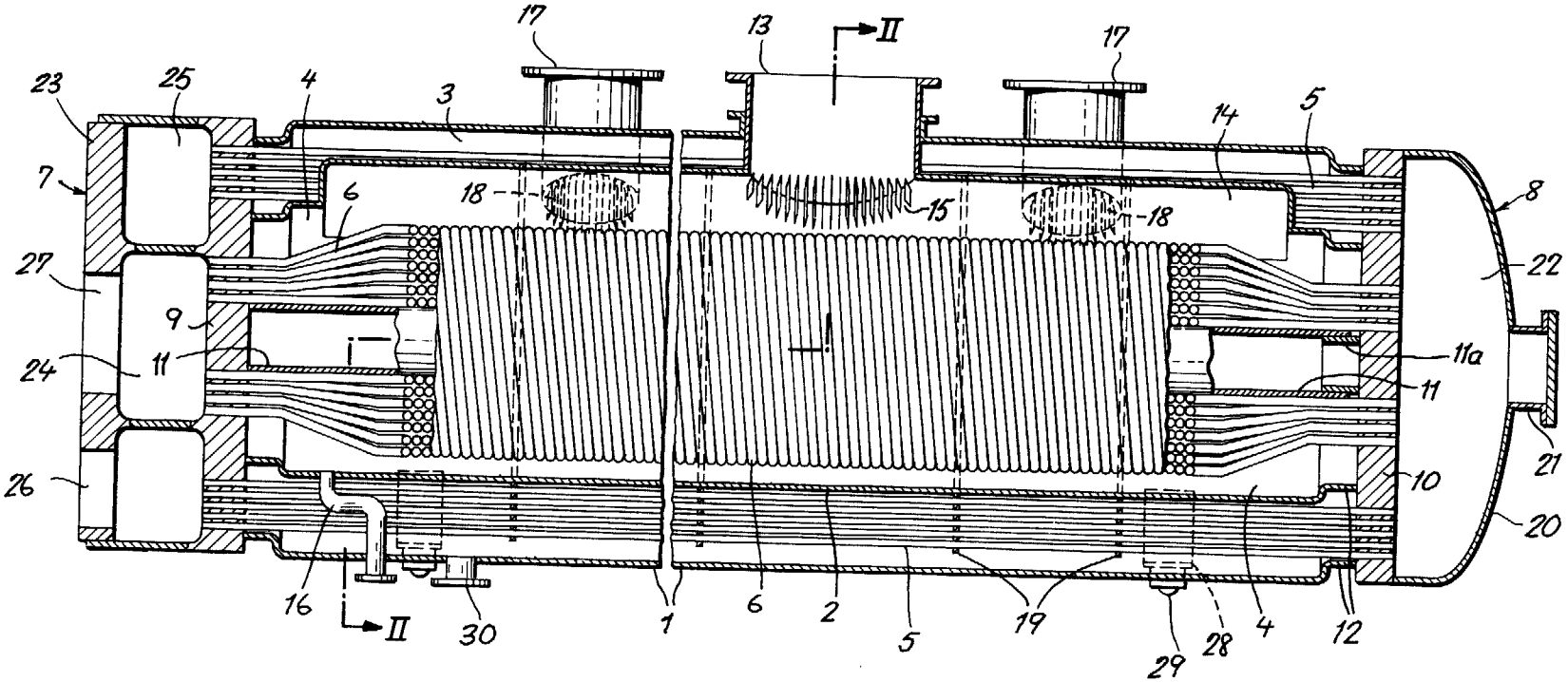
FIG. 1 is a longitudinal cross section through a feed water preheater for a turbine thermal power plant embodying the invention.

FIG. 1 is a longitudinal or axial cross section through the feed water preheating heat exchanger according to the invention which comprises an outer cylindrical shell 1 and an inner cylindrical shell 2 coaxial with the outer cylindrical shell 1.

These shells define between them an outer annular compartment 3 extending axially the full length of the tube shells and the inner cylindrical shell 2 defines an inner annular compartment 4 as well.

The outer annular compartment 3 receives a tube bundle 5 made up of straight tubes while the inner annular compartment 4 receives a tube bundle 6 of helically coiled tubes. The tube bundles 5 and 6 terminate in the region of the first axial end 7 and the second axial end 8 of the heat exchanger in tube sheets 9 and 10 respectively.

Within the inner cylindrical shell 4 and interconnecting the tube sheets 9 and 10 is a core tube 11 upon which the coiled-tube bundle 6 is wound. The core tube 11 is rigidly connected to the tube sheet 9, e.g. by welding, but is flexibly connected with the tube sheet 10 by elastic means such as a telescoping joint as represented at 11*a* diagrammatically in FIG. 1. The tubes of the coiled-tube bundle 6 are wound tightly and in helical layers upon the core tube 11 and the "hand" or sense of rotation of the successive layers is preferably opposite.

The outer and inner cylindrical shells are joined to the tube sheets 9 and 10 by yieldable portions 12 which allow axial expansion and contraction of the tube sheets without deformation of the shells and permit the heat exchanger to respond to dimensional variations producted by changing temperatures.

Figure 2:
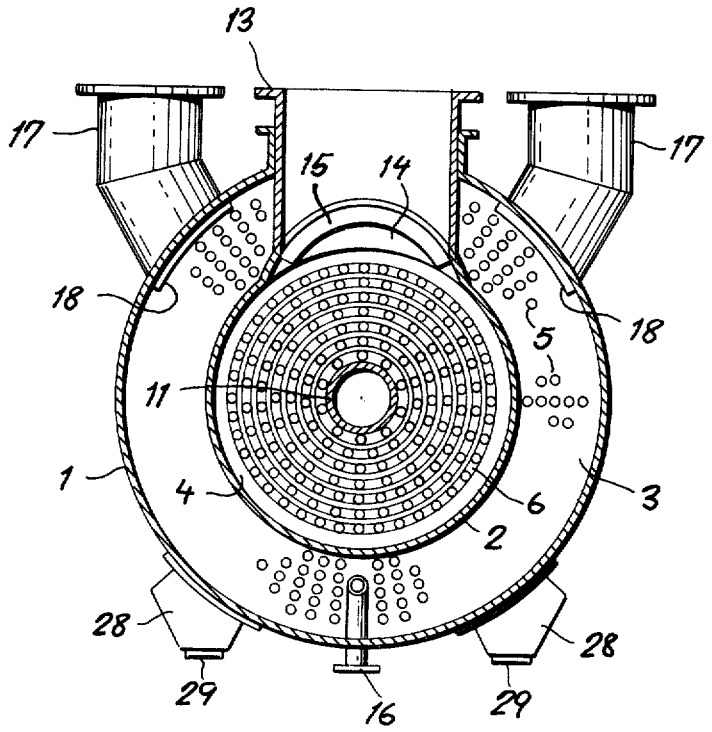
FIG. 2 is a transverse cross section through the heat exchanger represented in FIG. 1 and taken generally along the line II — II thereof.

An inlet 13 is provided for the inner annular chamber 4 in the region of the second end and passes through the outer annular chamber 3 from the top of the heat exchanger (see FIGS 1 and 2).

For a more effective distribution of the fluid, e.g. high pressure steam, the upper portion of the inner shell 2 is provided over substantially its entire length with an inlet chamber 14. The inlet chamber 14, in the region of the inlet 13 can be provided with baffle plates 15, e.g. a louver arrangement, to further distribute the fluids admitted through the inlet 13. The inlet chamber 14 and the inner annular compartment 4 are freely connected.

The outlet 16, which can be bent to permit deformation to compensate for stresses in the system, leads depleted fluid from the inner annular chamber 4.

The outer annular chamber 3 is supplied with its heat exchange fluid, e.g. low pressure steam, from a plurality of inlets 17, preferably three in number (of which only two have been illustrated) which open directly into the outer compartment 3 at baffle plates 18 which also serve to distribute the steam around this chamber. Webs 19 stabilize the straight-tube bundle 5.

The outer annular compartment 3 and the inner annular compartment 4 are sealed from one another and are, as has been noted, provided with respective inlets and outlets independently from one another.

The tube sheet 10 at the second end of the heat exchanger is provided with a cover 20 which can be formed with a manhole 21 for access, the domed cover 20 defining a collecting and distributing chamber 22 which is completely sealed from the annular compartments. This chamber 22 collects the fluid arriving from the straight-tube bundle and feed this fluid uniformly to the coiled-tube bundle.

The the first end of theheat exchanger a cover 23 is connected to the tube sheet 9 and defines therewith a central collecting chamber 24 and an annular distribution chamber 25. An opening 26 communicates with the distribution chamber 25 and allows the feed water to be supplied thereto while an opening 27 is provided in the cover 23 to communicate with the collecting chamber 24 from which the heated feed water is led from the system. The fed water thus traverses the straight-tube bundle from left to right and the coiled-tube bundle from right to left, i.e. in opposite directions. The heat exchanger is supported by feed 28 which can be provided with rollers 29 to allow the heat exchanger to be slid into the space provided therefor in the turbine set.

In operation, the feed water is heated in counterflow by low pressure steam, e.g. steam at a pressure of less than 0.3 bar, and then with high pressure steam, for example at a pressure of approximately 1 bar, from a temperature of 30° C to a temperature of about 100° C. The feed water can flow through the system at a pressure of 30 bar at which it is recovered from the port 27, having been supplied at the port 26. The feed water initially passes through the straight-tube bundle 5 into the chamber 22 and then passes through the coiled-tube bundle 6 to the first end of the heat exchanger.

The low pressure steam initially involved in the heat exchange with the water is supplied through the inlet 17 and the resulting condensate is recovered through an outlet 30 at the bottom of the heat exchange. The high pressure steam is supplied through inlet 13 and is distributed at 14 and 15 for uniform contact with the coiled type bundle 6. This steam condenses and is recovered at outlet 16.

As a comparison of FIG. 2 with FIG. 1 will show, the inlets 17 are provided in pairs to opposite sides of a vertical median plane through the heat exchanger perpendicular to the axis thereof. Obviously the inlets 17 do not lie in the same plane as the inlet 13 for the high pressure steam.

The tubes of the coiled-tube bundle are, for example up to three times as long as the tubes of the straight-tube bundle 5.

Figure 3:
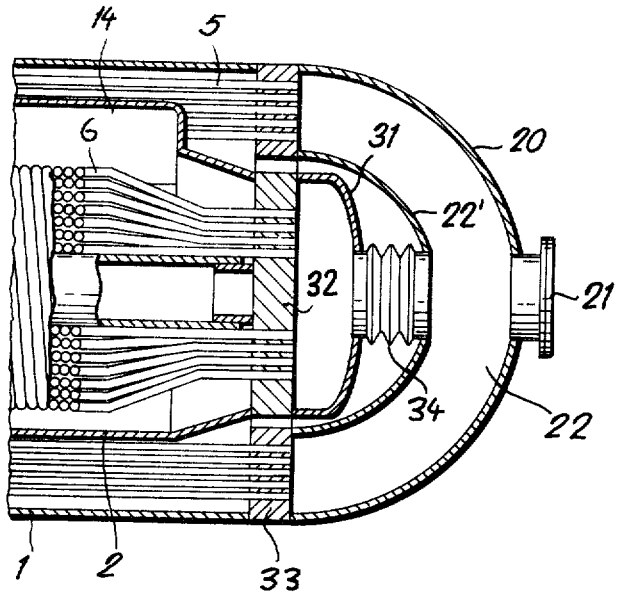
FIG. 3 is a longitudinal section through another embodiment of a heat exchanger accarding to the invention.

FIG. 3 shows a portion, in longitudinal section of the second axial end of a heat exchanger according to the invention, the remainder thereof being identical to that of FIG. 1. Here, however, the outer and inner shells 1 and 2 are not provided with yieldable portions. Instead, a floating head 31 is provided to elastically seal the two annular compartments from one another. The tube sheet 32, 33 is here provided in two parts, namely, the circular inner part 32 forming the tube sheet of the coiled-tube bundle 6 and an annular outer part 33 forming the tube sheet for the straight-tube bundle 5. Between the floating head 31 and the domed cover 20 there is formed a chamber 22 serving as the collecting chamber for the fluid emerging from the straight tubes. The fluid passes through a bellows 34 disposed between the inner wall 22' of the chamber 22 and the floating head 31 to enter the coiled-tube bundle 3.

Figure 4:
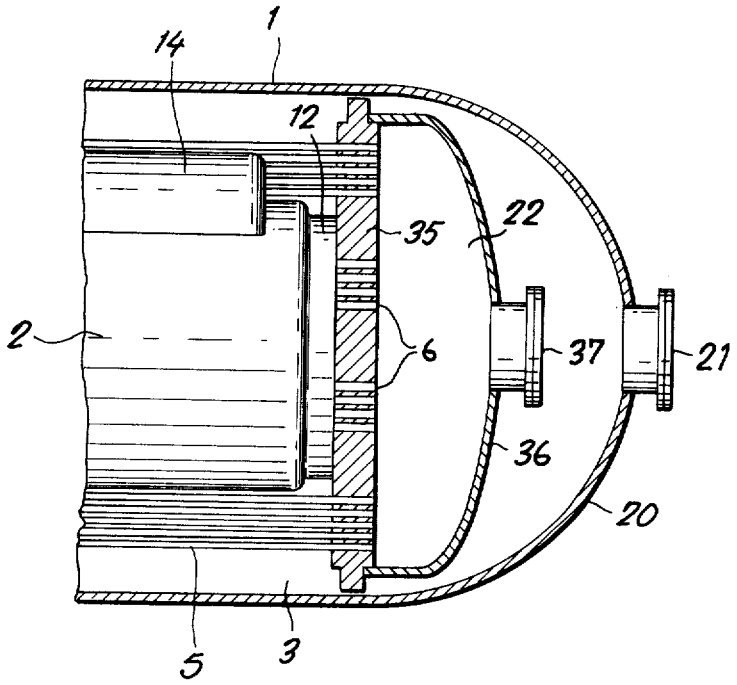
FIG. 4 is a view similar to FIG. 3 of the second end of a heat exchanger in another embodiment of the invention.

FIG. 4 shows another arrangement of this end of the heat exchanger. Here the inner shell 2 is connected by a yieldable portion 12 to the tube sheet 35 which, however, is free to float with respect to the outer shell 1. The outer shell is provided directly with a domed cover 20 having a covered manhole 21. Fluid flow between the straight-tube and coiled-tube bundles is effected by a domed cover 36 via a chamber 22. A covered manhole 37 is provided for this intervening dome 36 which is disposed within the dome 20. Unhindered relative longitudinal movement of the shell 1 and the tube sheet 35 is thus permitted. The rigidly elements of the heat exchanger according to the invention are preferably connected (welded) together.

We claim:

1. A heat exchanger comprising:

at least two cylindrical shells in nested relation defining an outer annular compartment and an inner annular compartment;

means for passing at least one first heat exchange fluid through said compartments;

a straight-tube bundle extending through one of said compartments;

a coiled-tube bundle received within said inner compartment; and means for passing at least one second heat exchange fluid through said tube bundles, said tube bundles having flow cross sections connected in series with said second fluid passing through said coiled-tube bundle in a direction opposite the direction of flow of said second fluid through said straight-tube bundle, said annular compartments being sealed from one another, said means for passing at least one first fluid through said compartments including a respective inlet and outlet for each compartment, said inner compartment including means forming an inlet chamber extending substantially the full length of said inner compartment.

2. The heat exchanger defined in claim 1, further comprising baffle plates at each of said inlets for distributing said first fluid in said compartments.

3. The heat exchanger defined in claim 2, further comprising means at one end of said shells forming a chamber communicating between said tube bundles.

4. The heat exchanger defined in claim 3, further comprising means at an opposite end of said shells defining a collecting chamber communicating with the tubes of said collecting chamber communicating with the tubes of said coiled-tube bundle and a distributing chamber coaxial with said collecting chamber and communicating with the tubes of said straight-tube bundle.

5. The heat exchanger defined in claim 4 wherein said means at said one end includes a domed cover, said heat exchanger further comrpising at least one tube sheet at said one end connected to the tubes of at least one of said bundles, said domed cover being affixed to said tube sheet.

6. The heat exchanger defined in claim 5 wherein said shells are coaxial and have horizontal axes, said inlets are provided along an upper portion of the heat exchanger, said outlets are provided at a lower portion thereof, and said heat exchanger further comprises means enabling relative axial expansion and contraction of said shells.

7. The heat exchanger defined in claim 6, further comprising a core tube extending through the innermost shell, said coiled-tube bundle being wound around said core tube.

* * * * *